United States Patent [19]

Shibata

[11] Patent Number: 4,672,008

[45] Date of Patent: Jun. 9, 1987

[54] INTERNAL OXIDIZED AG-SN-IN SYSTEM ALLOY ELECTRICAL CONTACT COMPOSITE

[75] Inventor: Akira Shibata, Yokohama, Japan

[73] Assignee: Chugai Denki Kogyo Kabushiki Kaisha, Tokyo, Japan

[21] Appl. No.: 792,018

[22] Filed: Oct. 28, 1985

[30] Foreign Application Priority Data

Nov. 8, 1984 [JP] Japan ..... 59-235499

[51] Int. Cl.[4] ..... C22C 5/06

[52] U.S. Cl. ..... 428/673; 148/431; 428/929

[58] Field of Search ..... 148/431; 420/501, 506; 428/673, 929

[56] References Cited

U.S. PATENT DOCUMENTS

| | | | |
|---|---|---|---|
| 4,161,403 | 7/1979 | Shibata | 148/431 |
| 4,412,971 | 11/1983 | Shibata | 410/501 |

FOREIGN PATENT DOCUMENTS

| | | | |
|---|---|---|---|
| 132358 | 9/1978 | German Democratic Rep. | 428/673 |
| 156922 | 9/1982 | German Democratic Rep. | 428/673 |
| 90132 | 8/1978 | Japan | 148/431 |
| 101307 | 6/1982 | Japan | 428/673 |

*Primary Examiner*—Christopher W. Brody

*Attorney, Agent, or Firm*—Shlesinger Fitzsimmons Shlesinger

[57] ABSTRACT

Electrical contact materials made from Ag-Sn-In system alloys which have been internally oxidized. A substratum or base part of the materials is internally oxidized after having been clad with a thin layer of alloys of the same alloy system, concentration of solute elements of which is, however, smaller than that of the substratum alloys, so that no segregation of the solute metal elements shall be produced within the substratum alloys. Electrical contact resistance and consequent temperature raise of the internally oxidized materials under operation are considerably lowered.

6 Claims, No Drawings

INTERNAL OXIDIZED AG-SN-IN SYSTEM ALLOY ELECTRICAL CONTACT COMPOSITE

BACKGROUND OF THE INVENTION

This invention relates to an electrical contact material.

Ag-Sn-In system alloys which have been internally oxidized, are advantageously employed today as electrical contact materials. Since in their Ag matrices there are dispersed very minute particles of oxides of solute metal elements, electrical characteristics, particularly refractoriness afforded to the materials are excellent. However, it is observed sometimes that they show a comparatively high electrical resistance particularly at an initial stage of use. This comparatively high contact resistance brings about often a temperature raise of contact surfaces of the materials.

These phonomena, that is, high electrical contact resistances and surface temperature raise are chiefly due to segregation or depletion layers often seen at outer surface areas of Ag-Sn-In system alloys which have been internally oxidized.

BRIEF SUMMARY OF THE INVENTION

The primary object of this invention is therefore to overcome the above-mentioned drawbacks which are inherently common to the internally oxidized Ag-Sn-In system alloys.

A silver alloy which contains 5–12 weight % of Sn and 1–8 weight % of In and has been internally oxidized, and in which a total amount of said Sn and In is within 7 –18 weight %, has excellent electrical characteristics as explained above, except that it has a comparatively high electrical contact resistance and consequently presents a comparatively high temperature raise. The lower limits of Sn and In and their total given above are such amounts by which the minimum requirement of refractoriness for the materials can be attained, while the upper limits are to prevent the materials from being brittle.

It has been found that when said kind of Ag-Sn-In system alloys as substratums are clad at their surfaces by a thin layer of silver alloys containing Sn at a smaller amount than the Sn contained in the substratum alloys and then internally oxidized no segregation or depletion of tin oxide is produced at their surfaces. The working principle of this invention is to utilize the thin layer as a screen which controls paths of oxygen given to the substratum alloy for the internal oxidation thereof. In other words, the passage of oxygen through the thin layer of silver alloy, more particularly through silver matrix thereof, somewhat becomes inhibited or moderate and therefore internally oxidizes the substratum gradually without the production of any segregation of metal oxides within the substratum.

In this invention, the thin layer of silver alloy which is clad over the substratum, could be internal oxidized simultaneously with the internal oxidation of the substratum, or could be internally oxidized separately from the internal oxidation of the substratum. Or, it could be a powder-metallurgically sintered Ag alloy which contains preoxidized tin oxide. However, the substratum alloy should be internally oxidized after having been clad by the thin layer of silver alloy. This differs from conventional composite electrical contact materials in which a substratum silver alloy which has been internally oxidized is clad by other materials.

While preferred constitutional ratios of solute metral elements employed in the substratum silver alloy in accordance with this invention are explained above, those for the thin layer are, so far as concerned with lower limits, 3% for Sn and 1% for In, the minimum total amount of said Sn and In being 3.5%, because otherwise the thin layer would not be afforded with sufficient refractoriness. Their upper limits can hardly be defined, when the thin layer is made from powder-metallurgically prepared alloys. However, when a consideration has to be paid on the points that the thin layer should not be too brittle and that it shall not produce any segregation of metal oxides when subjected to internal oxidation, its upper constitutional ratios are preferably 6% for Sn and 6% for In, maximum total amount being 9%.

In order to modify electrical characteristics of the materials made in accordance with this invention, one or more of metal elements selected from a group consisting of Cd, Sb, Zn, Mn, Ca, Mg, and Bi could be added to the substratum alloy. Their amount will be within a range which shall not change fundamentally such characteristics which are to be inherent to the substratum alloy, that is, 0.01–5%. These auxiliary solute metals may be added also to the thin layer alloy at a small amount, that is, 0.01–4% so that said alloy could be clad over the substratum with a good rate of elongation.

One or more of elements selected from a group consisting of Co, Ni, and Fe may also be added to the substratum and/or thin layer alloys at an amount of 0.01 to 1%, so that they can make crystalline structures of the alloys more fine.

DETAILED DESCRIPTION

This invention is further described in detail by way of examples.

EXAMPLE 1

(1) Ag-Sn 8%-In 4.5%—Known electrical contact material:

A contact material (of this invention):

(1) Ag-Sn 8%-In 4.5% (substratum):

(2) Ag-Sn 5%-In 3% (thin layer):

B contact material (of this invention):

(3) Ag-Sn 8%-In 4.5%-Ca 0.1% (substratum):

(4) Ag-Sn 5%-In 3%-Co 0.2% (thin layer):

C contact material (of this invention):

(5) Ag-Sn 8%-In 4.5%-Bi 0.2% (substratum):

(6) Ag-Sn 5%-In 3%-Cd 2% (thin layer):

The above alloys (1)–(6) were heated and melted respectively in a high frequency melting furnace at about 1,000°–1,200° C. Each of them was poured into a mold to obtain a plate of ingot. The thickness of ingots of the alloys (1), (3), and (5) was made to 4 mm, while the ingots of the alloys (2), (4), and (6) was made to 2 mm in thickness.

The ingot plate (2) was placed over a surface of the ingot plate (1), and a pure silver plate of 4 mm in thickness was placed at another surface of the ingot plate (1). They were pressed and rolled at 600°–700° C., annealed, and cold-rolled to obtain the A contact material of 2 mm in thickness. The thickness of the top thin layer of Ag-Sn 5%-In 3% became to about 0.05 mm, while the thickness of the bottom pure silver layer became to about 0.1 mm.

The A contact material thus obtained was punched to obtain contact pieces of 6 mm in diameter. The contact pieces were internally oxidized in an oxgen atmosphere of 10 atm. at 680° C. and for 24 hours.

Similarly to the production of A contact material, the B and C contact materials were made.

In order to make comparative tests, the known electrical contact material (1) was made by bonding to a bottom surface of the alloy (1) a pure silver plate, and then internally oxidizing. This known material (1) thus made was contact pieces of 6 mm in diameter and about 0.1 mm in thickness, which were bonded at their bottom surfaces by pure silver layers of about 2 mm in thickness.

The contact materials A–C thus prepared in accordance with this invention and the known contact material (1) were tested by an ASTM-50 testing machine about their initial contact resistance and temperature raise (the raise above a room temperature) at terminals connected to the materials after 1,000 switching cycles.

The test conditions were as follows, and test results are given in the following Tables 1 and 2.

Initial contact resistance test:

Contact force: 400 g

Current: DC 6V, 1A.

Temperature raise test:

Load: AC 200V 50A pf=0.23

Frequency: 60 cycles/minute.

TABLE 1

| | Initial contact resistance (m Ω) |
|---|---|
| Material A | 0.3–0.9 |
| B | 0.4–1.2 |
| C | 0.4–0.8 |
| Known material (1) | 0.3–2.2 |

TABLE 2

| | Temperature raise (°C.) |
|---|---|
| Material A | 55–60 |
| B | 52–61 |
| C | 50–58 |
| Known material (1) | 60–75 |

As readily understood from the above Tables 1 and 2, the electrical contact materials made in accordance with this invention are superior to the comparable known contact material with respect to their lower contact resistance and temperature raise.

EXAMPLE 2

A sheet of 1 mm in thickness of Ag-Sn 7.5%-In 4%-Ni 0.1% alloy was used as a substratum. To a surface of this substratum, there was clad a thin layer of sheet which was prepared by sintering 6% of tin oxide powder and the balance % of silver powder, while to another surface of the substratum alloy sheet there was clad a pure silver plate which was in turn clad by a Ni plate. After they were internally oxidized, the Ni plate was removed off. The material thus made in accordance with this invention showed also good test results which are comparable to those given in the Table 1 and 2.

I claim:

1. An electrical contact material consisting of a substratum made from a silver alloy 5–12 weight % of Sn and 1–8 weight % of In, the total amount of said Sn and In being 7–8 weight %, and a thin layer bonded on the substratum and acting as an initial contact surface, and being made by sintering preoxidized particles of a silver alloy containing Sn at a substantive amount smaller than the Sn contained in the substratum silver alloy, the solute metal elements in the substratum having been internally oxidized, and those in the thin layer having been preoxidized prior to sintering.

2. An electrical contact material as claimed in claim 1, in which the thin layer silver alloy comprising 3–6 weight % of Sn and 1–6 weight % of In, the total amount of this Sn and In being 3.5–9 weight %.

3. An electrical contact material as claimed in claim 2, in which the substratum silver alloy contains 0.01–5 weight % of one or more elements selected from a group consisting of Cd, Sb, Zn, Mn, Ca, Mg, and Bi.

4. An electrical contact material as claimed in claim 2, in which the substratum silver alloy contains 0.01–1 weight % of one or more elements selected from a group consisting of Co, Ni, and Fe.

5. An electrical contact material as claimed in claim 2, in which the thin layer silver alloy contains 0.01–5 weight % of one or more elements selected from a group consisting of Cd, Sb, Zn, Mn, Ca, Mg, and Bi.

6. An electrical contact material as claimed in claim 2, in which the thin layer silver alloy contains 0.01–1 weight % of one or more elements selected from a group consisting of Co, Ni, and Fe.

* * * * *